US008889606B2

(12) United States Patent
Chase et al.

(10) Patent No.: US 8,889,606 B2
(45) Date of Patent: Nov. 18, 2014

(54) LUBRICANT COMPOSITION

(71) Applicant: R.T. Vanderbilt Company, Inc., Norwalk, CT (US)

(72) Inventors: Kevin J. Chase, Brandford, CT (US); William T. Wallack, Stamford, CT (US)

(73) Assignee: Vanderbilt Chemicals, LLC, Norwalk, CT (US)

( * ) Notice: Subject to any disclaimer, the term of this patent is extended or adjusted under 35 U.S.C. 154(b) by 254 days.

(21) Appl. No.: 13/649,577

(22) Filed: Oct. 11, 2012

(65) Prior Publication Data

US 2013/0123156 A1 May 16, 2013

Related U.S. Application Data

(60) Provisional application No. 61/558,617, filed on Nov. 11, 2011.

(51) Int. Cl.

| | |
|---|---|
| ***C10M 133/22*** | (2006.01) |
| ***C10M 133/28*** | (2006.01) |
| ***C10M 161/00*** | (2006.01) |

(52) U.S. Cl.

CPC ..... *C10M 161/00* (2013.01); *C10M 2215/182* (2013.01); *C10M 133/28* (2013.01); *C10M 133/22* (2013.01); *C10M 2215/22* (2013.01); *C10M 2203/10* (2013.01); *C10M 2209/084* (2013.01); *C10N 2230/10* (2013.01); *C10N 2230/12* (2013.01); *C10N 2270/00* (2013.01)

USPC ..... 508/281; 508/280

(58) Field of Classification Search

CPC ..... C10M 133/28; C10M 133/38

USPC ..... 508/280

See application file for complete search history.

(56) References Cited

U.S. PATENT DOCUMENTS

| | | | | |
|---|---|---|---|---|
| 4,202,783 | A * | 5/1980 | Chibnik | 508/281 |
| 4,880,551 | A * | 11/1989 | Doe | 508/281 |
| 5,368,761 | A | 11/1994 | Gore et al. | |
| 6,184,262 | B1 | 2/2001 | Suhoza et al. | |
| 6,743,759 | B2 | 6/2004 | Stunkel et al. | |
| 7,838,470 | B2 | 11/2010 | Shaw et al. | |
| 8,222,345 | B2 | 7/2012 | Abhari et al. | |
| 2003/0134753 | A1 | 7/2003 | Stunkel et al. | |
| 2007/0270317 | A1 * | 11/2007 | Milner et al. | 508/460 |

FOREIGN PATENT DOCUMENTS

| | | | |
|---|---|---|---|
| EP | 0 493 928 | A1 | 7/1992 |
| WO | 2008/055797 | A1 | 5/2008 |

OTHER PUBLICATIONS

R.T. Vanderbilt Company, Inc., Material Safety Data Sheet, VANLUBE 887, Jul. 28, 2005. [Retrieved on Oct. 21, 2013]. <URL: http://web.archive.org/web/20060311133030/http://www.rtvanderbilt.com/documents/MSDS/US/53079.pdf> entire document.

* cited by examiner

*Primary Examiner* — Taiwo Oladapo

(74) *Attorney, Agent, or Firm* — Norris McLaughlin & Marcus P.A.

(57) ABSTRACT

1-[Di(4-octylphenyl)aminomethyl]tolutriazole is prepared in a mineral oil wherein the reaction also contains between 0.1 and 5% by weight of a polyacrylate polymer dissolved in a mineral oil. The liquid product shows increased storage stability with respect to crystallization of the 1-[di(4-octylphenyl)aminomethyl]tolutriazole when the polyacrylate polymer is added during the reaction to prepare the 1-[Di(4-octylphenyl)aminomethyl]tolutriazole. This product can be utilized in a lubricant composition as an antioxidant and corrosion inhibitor.

9 Claims, No Drawings

LUBRICANT COMPOSITION

BACKGROUND OF THE INVENTION

This invention concerns a component to a lubricating composition that imparts improved resistance to oxidation and corrosion. Specifically the component, 1-[Di(4-octylphenyl) aminomethyl]tolutriazole dissolved in 40-60% mineral oil has difficulty maintaining its liquid character over time, and has a short storage stability. This makes it difficult to handle when preparing lubricant additive blends and lubricant compositions.

The 1-[alkyl diphenyl)aminomethyl]tolutriazole or benzotriazole compounds are prepared in a known manner from tolutriazole or benzotriazole (or mixtures thereof), formaldehyde and alkylated diphenylamine by means of the Mannich reaction. These variations are described in U.S. Pat. No. 6,184,262, which is hereby incorporated by reference. The benzotriazole derivatives of formula I (I)

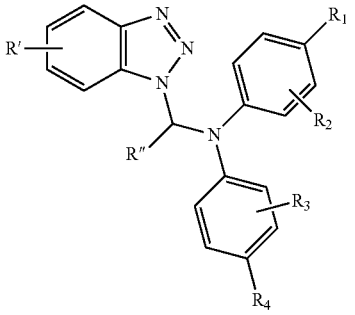

wherein R' and R" are independently selected from hydrogen or lower alkyl, $R_1$-$R_4$ are independently selected from alkyl having up to 11 carbon atoms or phenylalkyl, or mixtures thereof. Tolutriazole designates a benzotriazole compound which is methylated in the benzene ring in the 4-position and/or 5-position. Therefore, the derivative is designated "benzotriazole derivative".

The component, 1-[Di(4-octylphenyl)aminomethyl]tolutriazole, (formula II) is a well-known antioxidant and corrosion inhibitor. In U.S. Pat. Nos. 4,880,551 and 6,743,759 it was reported that 1-[Di(4-octylphenyl)aminomethyl]tolutriazole acts as an antioxidant synergist with methylenebis (di-nburtyldithiocarbamate) and also with phenols.

(II)

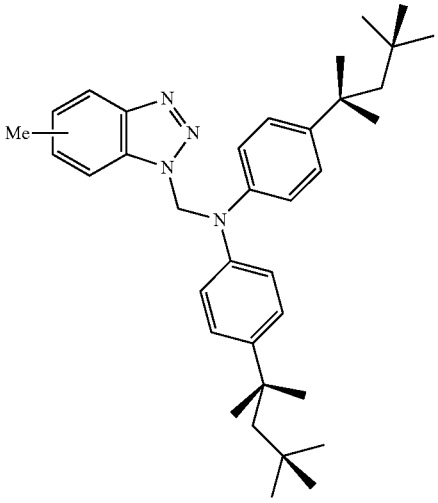

Lubricating oils, greases and similar oleaginous materials are used under conditions which contribute to their breakdown during normal service. The severe high temperature operating conditions of modern engines accelerate deterioration of lubricants due to oxidation. Oxidative deterioration is accompanied by formation of gum, sludge and acids which may cause corrosion of the engine as well as chemical breakdown of the lubricant.

Surprisingly, it has been found that the addition of a polyacrylate polymer during the reaction to produce the 1-[Di(4-octylphenyl)aminomethyl]tolutriazole in a mineral oil diluent has been instrumental in keeping the product in solution for an extended period, longer than the mere addition of the polyacrylate polymer to the product after the reaction. This polyacrylate polymer is added at an amount between about 0.1 and about 5%, preferably about 0.2 to about 2.0%, and most preferably at about 0.5 to about 1.0% to the total weight of the reaction mixture. The polyacrylate polymer itself is a solution that typically contains between 25 and 75% polyacrylate polymer in oil.

SUMMARY OF THE INVENTION

The addition of a polyacrylate polymer during the reaction to produce 1-[Di(4-octylphenyl)aminomethyl]tolutriazole in a mineral oil diluent has shown to have superior crystallization-resisting properties compared to a tolutriazole without added polyacrylate polymer. Furthermore, the addition of a polyacrylate polymer solution during the reaction to produce 1-[Di(4-octylphenyl)aminomethyl]tolutriazole utilizing a mineral oil diluent has shown to have superior crystallization-resisting properties compared to the addition of polyacrylate polymer after the reaction which forms the 1-[Di(4-octylphenyl)aminomethyl]tolutriazole.

Another aspect of the invention concerns lubricating compositions having improved antioxidant properties and comprising a major portion of an oil of lubricating viscosity and an oxidation inhibiting amount of a synergistic antioxidant composition containing 1-[di(4-octylphenyl)aminomethyl]-tolutriazole having polyacrylate polymer added during the formation reaction of the tolutriazole. The effective amount of the composition ranges between about 0.01 to about 5.0% by weight of the total lubricating formulation, more preferred is about 0.1 to about 3.0%, and most preferred is about 0.5 to 2%.

DETAILED DESCRIPTION OF THE INVENTION

The 1-[di(4-octylphenyl)aminomethyl]tolutriazole is prepared in a known manner from tolutriazole, formaldehyde and dioctylated phenylamine by means of the Mannich reaction. Tolutriazole designates a benzotriazole compound which is methylated in the benzene ring in the 4-position and/or 5-position. The reaction is typically run in a mineral oil diluent at 50% by weight, which remains with the product.

The nature of the product with its stereoregular branched alkyl chains and phenyl rings lends itself to crystallization. It has been long known that highly branched alkyl chains promotes crystal formation. For example, the highly branched tert-butanol is a solid at room temperature with a melting point of about 25° C., but the related n-butanol has a melting point of −90° C. This is due to the lack of degrees of freedom of motion the highly branched tert-butanol has compared to the n-butanol. Similarly, the 1-[di(4-octylphenyl)aminomethyl]tolutriazole is prepared from a diphenylamine derivative containing alkyl chains in the 4-position of the two phenyl rings that are highly stereoregular, being derived from diisobutylene. These limit the degrees of freedom of motion, enhancing crystallization.

Polyacrylate polymers are normally used as viscosity modifiers, pour point depressants and wax crystal modifiers. These polyacrylate polymers are acrylate polymers with short, medium or long alkyl chains residing on the ester portions of the acrylate polymer. Included are methylacrylate polymers and polymethacrylates, and oligomers of acrylates. Examples of viscosity modifiers can be found in U.S. Pat. No. 7,838,470, which is incorporated herein by reference. Examples of pour point depressants can be found in U.S. Pat. No. 5,368,761, incorporated herein by reference. Examples of wax crystal modifiers can be found in U.S. Pat. No. 8,222,345, incorporated herein by reference. Further commercial examples are the Viscoplex® polyacrylate polymers from Evonik/RohMax®. These materials are acrylate polymers and copolymers blended with mineral oils. Another example is Hitec® 5714 from Afton Chemical.

Base Oils

The base oils employed as lubricant vehicles are typical oils used in automotive and industrial applications such as, among others, turbine oils, hydraulic oils, gear oils, crankcase oils and diesel oils. Natural base oils include mineral oils, petroleum oils, paraffinic oils and the vegetable oils. The base oil may also be selected from oils derived from petroleum hydrocarbon and synthetic sources. The hydrocarbon base oil may be selected from naphthenic, aromatic, and paraffinic mineral oils. The synthetic oils may be selected from, among others, ester-type oils (such as silicate esters, pentaerythritol esters and carboxylic acid esters), hydrogenated mineral oils, silicones, silanes, polysiloxanes, alkylene polymers, and polyglycol ethers.

The lubricating composition may contain the necessary ingredients including the following:

1. Borated and/or non-borated dispersants
2. Additional antioxidant compounds
3. Friction modifiers
4. Pressure/anti-wear additives
5. Viscosity modifiers
6. Pour point depressants
7. Detergents
8. Antifoaming agents 1. Borated and/or Non-Borated Dispersants Non-borated ashless dispersants may be incorporated within the final fluid composition in an amount comprising up to 10 weight percent on an oil-free basis. Many types of ashless dispersants listed below are known in the art. Borated ashless dispersants may also be included.

(A) "Carboxylic dispersants" are reaction products of carboxylic acylating agents (acids, anhydrides, esters, etc.) containing at least about 34 and preferably at least about 54 carbon atoms reacted with nitrogen-containing compounds (such as amines), organic hydroxy compounds (such aliphatic compounds including monohydric and polyhydric alcohols, or aromatic compounds including phenols and naphthols), and/or basic inorganic materials. These reaction products include imide, amide and ester reaction products of carboxylic acylating agents. Examples of these materials include succinimide dispersants and carboxylic ester dispersants. The carboxylic acylating agents include alkyl succinic acids and anhydrides wherein the alkyl group is a polybutyl moiety, fatty acids, isoaliphatic acids (e.g., 8-methyloctadecanoic acid), dimer acids, addition dicarboxylic acids, addition (4+2 and 2+2) products of an unsaturated fatty acid with an unsaturated carboxylic reagent), trimer acids, addition tricarboxylic acids (e.g., Empol® 1040, Hystrene® 5460 and Unidyme® 60), and hydrocarbyl substituted carboxylic acylating agents (from olefins and/or polyalkenes). In one preferred embodiment, the carboxylic acylating agent is a fatty acid. Fatty acids generally contain from about 8 up to about 30, or from about 12 up to about 24 carbon atoms. Carboxylic acylating agents are taught in U.S. Pat. Nos. 2,444,328, 3,219,666 and 4,234,435, which are incorporated herein by reference. The amine may be a mono- or polyamine. The monoamines generally have at least one hydrocarbyl group containing 1 to about 24 carbon atoms, with from 1 to about 12 carbon atoms. Examples of monoamines include fatty ($C_8$-$C_{30}$) amines, primary ether amines, tertiary-aliphatic primary amines, hydroxyamines (primary, secondary or tertiary alkanol amines), ether N-(hydroxyhydrocarbyl)amines, and hydroxyhydrocarbyl amines. The polyamines include alkoxylated diamines, fatty diamines, alkylenepolyamines (ethylenepolyamines), hydroxy-containing polyamines, polyoxyalkylene polyamines, condensed polyamines (a condensation reaction between at least one hydroxy compound with at least one polyamine reactant containing at least one primary or secondary amino group), and heterocyclic polyamines. Useful amines include those disclosed in U.S. Pat. No. 4,234,435 and U.S. Pat. No. 5,230,714 that are incorporated herein by reference. Examples of these "carboxylic dispersants" are described in British Patent 1,306,529 and in U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, and Re 26,433, which are incorporated herein by reference for disclosure of dispersants.

(B) "Amine dispersants" are reaction products of relatively high molecular weight aliphatic or alicyclic halides and amines, preferably polyalkylene polyamines. Examples thereof are described, for example, in U.S. Pat. Nos. 3,275,554, 3,438,757, 3,454,555, and 3,565,804, which are incorporated herein by reference for disclosure of dispersants.

(C) "Mannich dispersants" are the reaction products of alkyl phenols in which the alkyl group contains at least about 30 carbon atoms with aldehydes (especially formaldehyde) and amines (especially polyalkylene polyamines). The materials described in U.S. Pat. Nos. 3,036,003, 3,236,770, 3,414,347, 3,448,047, 346,172, 3,539,633, 3,586,629, 3,591,598, 3,634,515, 3,725,480, and 3,726,882 are incorporated herein by reference for disclosure of dispersants.

(D) Post-treated dispersants are obtained by reacting carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds, phosphorus compounds, molybdenum compounds, tungsten compounds or the like. U.S. Pat. Nos. 3,200,107, 3,282,955, 3,367,943, 3,513,093, 3,639,242, 3,649,659, 3,442,808, 3,455,832, 3,579,450, 3,600,372, 3,702,757, 3,708,422, 4,259,194, 4,259,195, 4,263,152, 4,265,773, 7,858,565 and 7,879,777 are incorporated herein by reference for disclosure of dispersants.

(E) Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymer dispersants are disclosed in U.S. Pat. Nos. 3,329,658, 3,449,250, 3,519,656, 3,666,730, 3,687,849, and 3,702,300, which are incorporated herein by reference for disclosure of dispersants and ashless dispersants.

Borated dispersants are described in U.S. Pat. Nos. 3,087,936 and 3,254,025, which are incorporated herein by reference for disclosure of borated dispersants.

Also included, as possible dispersant additives are those disclosed in U.S. Pat. Nos. 5,198,133 and 4,857,214, which are incorporated herein by reference. The dispersants of these patents compare the reaction products of an alkenyl succinimide or succinimide ashless dispersant with a phosphorus ester or with an inorganic phosphorus-containing acid or anhydride and a boron compound.

2. Additional Antioxidant Compounds

Other antioxidant may be used in the compositions of the present invention, if desired. Typical antioxidants include hindered phenolic antioxidants, secondary aromatic amine antioxidants, hindered amine antioxidants, sulfurized phenolic antioxidants, oil-soluble copper compounds, phosphorus-containing antioxidants, organic sulfides, disulfides and polysulfides and the like.

Illustrative sterically hindered phenolic antioxidants include orthoalkylated phenolic compounds such as 2,6-di-tert-butylphenol, 4-methyl-2,6-di-tert-butylphenol, 2,4,6-tri-tert-butylphenol, 2-tert-butylphenol, 2,6-disopropylphenol, 2-methyl-6-tert-butylphenol, 2,4-dimethyl-6-tert-butylphenol, 4-(N,N-dimethylaminomethyl)-2,8-di-tert-butylphenol, 4-ethyl-2,6-di-tert-butylphenol, 2-methyl-6-styrylphenol, 2,6-distyryl-4-nonylphenol, and their analogs and homologs. Mixtures of two or more such mononuclear phenolic compounds are also suitable.

Other preferred phenol antioxidants for use in the compositions of this invention are methylene-bridged alkylphenols, and these can be used singly or in combinations with each other, or in combinations with sterically hindered un-bridged phenolic compounds. Illustrative methylene-bridged compounds include 4,4'-methylenebis(6-tert-butyl o-cresol), 4,4'-methylenebis(2-tert-amyl-o-cresol), 2,2'-methylenebis(4-methyl-6-tert-butylphenol), 4,4'-methylenebis(2,6-di-tert-butylphenol) and similar compounds. Particularly preferred are mixtures of methylene-bridged alkylphenols such as are described in U.S. Pat. No. 3,211,652, which is incorporated herein by reference.

Amine antioxidants, especially oil-soluble aromatic secondary amines may also be used in the compositions of this invention. Although aromatic secondary monoamines are preferred, aromatic secondary polyamines are also suitable. Illustrative aromatic secondary monoamines include diphenylamine, alkyl diphenylamines containing 1 or 2 alkyl substituents each having up to about 16 carbon atoms, phenyl-.beta.-naphthylamine, phenyl-p-naphthylamine, alkyl- or aralkyl-substituted phenyl-.beta.-naphthylamine containing one or two alkyl or aralkyl groups each having up to about 16 carbon atoms, alkyl- or aralkyl-substituted phenyl-p-naphthylamine containing one or two alkyl or aralkyl groups each having up to about 16 carbon atoms, and similar compounds.

A preferred type of aromatic amine antioxidant is an alkylated diphenylamine of the general formula:

$$R_5—C_6H_4—NH—C_6H_4—R_6$$

where $R_5$ is an alkyl group (preferably a branched alkyl group) having 8 to 12 carbon atoms, (more preferably 8 or 9 carbon atoms) and $R_6$ is a hydrogen atom or an alkyl group (preferably a branched alkyl group) having 8 to 12 carbon atoms, (more preferably 8 or 9 carbon atoms). Most preferably, $R_5$ and $R_6$ are the same. One such preferred compound is available commercially as Naugalube® 438L, a material which is understood to be predominately a 4,4'-dinonyldiphenylamine (i.e., bis(4-nonylphenyl)(amine)) in which the nonyl groups are branched.

The hindered amines are another type aminic antioxidants that may be used in compositions of this invention with two predominating types, the pyrimidines and piperidines. These are all described in great detail above, and in U.S. Pat. No. 5,073,278, U.S. Pat. No. 5,273,669, and U.S. Pat. No. 5,268,113. Preferred hindered amines include 4-stearoyloxy-2,2,6,6-tetramethylpiperidine and dodecyl-N-(2,2,6,6,-tetramethyl-4-piperidinyl)succinate, sold under the trade names Cyasorb® UV-3853 and Cyasorb® UV-3581 from Cytec, di(2,2,6,6-tetramethylpiperidin-4-yl) sebacate and di(1,2,2,6,6-pentamethylpiperidin-4-yl) sebacate, sold as Songlight® 7700 and Songlight® 2920LQ from Songwon, and bis(1-octyloxy-2,2,6,-tetramethyl-4-piperidyl) sebacate, sold as Tinuvin® 123 by Ciba.

Another useful type of antioxidant for preferred inclusion in the compositions of the invention are one or more liquid, partially sulfurized phenolic compounds such as are prepared by reacting sulfur monochloride with a liquid mixture of phenols—at least about 50 weight percent of which mixture of phenols is composed of one or more reactive, hindered phenols—in proportions to provide from about 0.3 to about 0.7 gram atoms of sulfur monochloride per mole of reactive, hindered phenol so as to produce a liquid product. Typical phenol mixtures useful in making such liquid product compositions include a mixture containing by weight about 75% of 2,6-di-tert-butylphenol, about 10% of 2-tert-butylphenol, about 13% of 2,4,6-tri-tert-butylphenol, and about 2% of 2,4-di-tert-butylphenol. The reaction is exothermic and thus is preferably kept within the range of about 15° C. to about 70° C., most preferably between about 40° C. to about 60° C.

Another useful type of antioxidant are 2,2,4-trimethyl-1,2-dihydroquinoline (TMDQ) polymers and homologs containing aromatized terminal units such as those described in U.S. Pat. No. 6,235,686, which is hereby incorporated by reference.

Sulfur containing materials such as the methylene bis(dialkyldithiocarbamates) wherein the alkyl group contains 4 to 8 carbon atoms are useful antioxidants. For example, methylenebis(dibutyldithiocarbamate) is commercially available as VANLUBE 7723® from R. T. Vanderbilt Co., Inc).

Mixtures of different antioxidants may also be used. One suitable mixture is comprised of a combination of: (i) an oil-soluble mixture of at least three different sterically hindered tertiary butylated monohydric phenols, which is in the liquid state at 25° C.; (ii) an oil-soluble mixture of at least three different sterically-hindered, tertiary butylated methylene-bridged polyphenols; and (iii) at least one bis(4-alkylphenyl) amine wherein the alkyl group is a branched alkyl group having 8 to 12 carbon atoms, the proportions of (i), (ii) and (iii) on a weight basis falling in the range of 3.5 to 5.0 parts of component (i) and 0.9 to 1.2 parts of component (ii) per part by weight of component (iii), as disclosed in U.S. Pat. No. 5,328,619, which is incorporated herein by reference.

Other useful preferred antioxidants are those included in the disclosure of U.S. Pat. No. 4,031,023, which is herein incorporated by reference.

3. Seal Swell Compositions

Compositions that are designed to keep seals pliable are also well known in the art. A preferred seal swell composition is isodecyl sulfolane. The seal swell agent is preferably incorporated into the composition at about 0.1-3 weight percent. Substituted 3-alkoxysulfolanes are disclosed in U.S. Pat. No. 4,029,587, which is incorporated herein by reference.

4. Friction Modifiers

Friction modifiers are also well known to those skilled in the art. A useful list of friction modifiers is included in U.S. Pat. No. 4,792,410, which is incorporated herein by reference. U.S. Pat. No. 5,110,488 discloses metal salts of fatty acids and especially zinc salts and is incorporated herein by reference. Useful friction modifiers include fatty phosphites, fatty acid amides, fatty epoxides, borated fatty epoxides, fatty amines, glycerol esters, borated glycerol esters alkoxylated fatty amines, borated alkoxylated fatty amines, metal salts of fatty acids, sulfurized olefins, fatty imidazolines, molybdenum dithiocarbamates (e.g., U.S. Pat. No. 4,259,254, incorporated herein by reference), molybdate esters (e.g., U.S. Pat. No. 5,137,647 and U.S. Pat. No. 4,889,647, both incorporated herein by reference), molybdate amine with sulfur donors (e.g., U.S. Pat. No. 4,164,473 incorporated herein by reference), and mixtures thereof.

The preferred friction modifier is a borated fatty epoxide as previously mentioned as being included for its boron content. Friction modifiers are preferably included in the compositions in the amounts of 0.1-10 weight percent and may be a single friction modifier or mixtures of two or more.

Friction modifiers also include metal salts of fatty acids. Preferred cations are zinc, magnesium, calcium, and sodium and any other alkali or alkaline earth metals may be used. The salts may be overbased by including an excess of cations per equivalent of amine. The excess cations are then treated with carbon dioxide to form the carbonate. The metal salts are prepared by reacting a suitable salt with the acid to form the salt, and where appropriate adding carbon dioxide to the reaction mixture to form the carbonate of any cation beyond that needed to form the salt. A preferred friction modifier is zinc oleate.

5. Extreme Pressure/Antiwear Agents

Dialkyl dithiophosphate succinates may be added to provide antiwear protection. Zinc salts are preferably added as zinc salts of phosphorodithioic acids. Among the preferred compounds for use are zinc diisooctyl dithiophosphate and zinc dibenzyl dithiophosphate Also included in lubricating compositions in the same weight percent range as the zinc salts to give antiwear/extreme pressure performance are dibutyl hydrogen phosphite (DBPH) and triphenyl monothiophosphate, and the thiocarbamate ester formed by reacting dibutyl amine, carbon disulfide and the methyl ester of acrylic acid. The thiocarbamate is described in U.S. Pat. No. 4,758,362 and the phosphorus-containing metal salts are described in U.S. Pat. No. 4,466,894. Both patents are incorporated herein by reference. Antimony or lead salts may also be used for extreme pressure. The preferred salts are of dithiocarbamic acid such as antimony diamyldithiocarbamate.

6. Viscosity Modifiers

Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers. Summaries of viscosity modifiers can be found in U.S. Pat. Nos. 5,157,088, 5,256,752 and 5,395,539, which are incorporated herein by reference. The VMs and/or DVMs preferably are incorporated into the fully formulated compositions at a level of up to 10% by weight.

7. Pour Point Depressants (PPD)

These components are particularly useful to improve low temperature qualities of lubricating oils. A preferred pour point depressant is an alkylnaphthalene. Pour point depressants are disclosed in U.S. Pat. Nos. 4,880,553 and 4,753,745, which are incorporated herein by reference. PPDs are commonly applied to lubricating compositions to reduce viscosity measured at low temperatures and low rates of shear. The pour point depressants are preferably used in the range of 0.1-5 weight percent. Examples of tests used to access low temperature, low shear rate rheology of lubricating fluids include ASTM D97 (pour point), ASTM D2983 (Brookfield viscosity), D4684 (Mini-rotary Viscometer) and D5133 (Scanning Brookfield).

8. Detergents

Lubricating compositions in many cases also preferably include detergents. Detergents as used herein are preferably metal salts of organic acids. The organic acid portion of the detergent is preferably a sulphonate, carboxylate, phenate, or salicylate. The metal portion of the detergent is preferably an alkali or alkaline earth metal. Preferred metals are sodium, calcium, potassium and magnesium. Preferably, the detergents are overbased, meaning that there is a stoichiometric excess of metal over that needed to form the neutral metal salt.

Preferred overbased organic salts are the sulfonate salts having a substantially oleophilic character and which are formed from organic materials. Organic sulfonates are well known materials in the lubricant and detergent arts. The sulfonate compound should preferably contain on average from about 10 to about 40 carbon atoms, more preferably from about 12 to about 36 carbon atoms and most preferably from about 14 to about 32 carton atoms on average. Similarly, the phenates, oxylates and carboxylates preferably have a substantially oleophilic character.

While the present invention allows for the carbon atoms to be either aromatic or in paraffinic configuration, it is highly preferred that alkylated aromatics be employed. While naphthalene based materials may be employed, the aromatic of choice is the benzene moiety.

The one particularly preferred component is thus an overbased monosulfonated alkylated benzene, and is preferably the monoalkylated benzene. Preferably, alkyl benzene fractions are obtained from still bottom sources and are mono- or di-alkylated compounds. It is believed, in the present invention, that the mono-alkylated aromatics are superior to the dialkylated aromatics in overall properties.

It is preferred that a mixture of mono-alkylated aromatics (benzene) be utilized to obtain the mono-alkylated salt (benzene sulfonate) in the present invention. The mixtures wherein a substantial portion of the composition contains polymers of propylene as the source of the alkyl groups assist in the solubility of the salt. The use of monofunctional (e.g., mono-sulfonated) materials avoids crosslinking of the molecules with less precipitation of the salt from the lubricant. It is preferred that the salt be overbased. The excess metal from overbasing has the effect of neutralizing acids, which may build up in the lubricant. A second advantage is that the overbased salt increases the dynamic coefficient of friction. Preferably, the excess metal will be present over that which is required to neutralize the acids at about in the ratio of up to about 30:1, preferably 5:1 to 18:1 on an equivalent basis.

The amount of the overbased salt utilized in the composition is preferably from about 0.1 to about 10 weight percents on an oil free basis. The overbased salt is usually made up in about 50% oil with a TBN range of 10-600 on an oil free basis. Borated and non-borated overbased detergents are described in U.S. Pat. Nos. 5,403,501 and 4,792,410, which are herein incorporated by reference for disclosure pertinent hereto.

9. Phosphates

The lubricating compositions can also preferably include at least one phosphorus acid, phosphorus acid salt, phosphorus acid ester or derivative thereof including sulfur-containing analogs preferably in the amount of 0.002-1.0 weight percent. The phosphorus acids, salts, esters or derivatives thereof include compounds selected from phosphorus acid esters or salts thereof, phosphites, phosphorus-containing amides, phosphorus-containing carboxylic acids or esters, phosphorus containing ethers and mixtures thereof.

In one embodiment, the phosphorus acid, ester or derivative can be a phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids.

One class of compounds are adducts of O,O-dialkyl-phosphorodithioates and esters of maleic or fumaric acid. The compounds can be prepared by known methods as described in U.S. Pat. No. 3,359,203, as for example O,O-di(2-ethylhexyl) S-(1,2-dicarbobutoxyethyl)phosphorodithioate.

The dithiophosphoric acid esters of carboxylic acid esters are another class of compounds useful to the invention. Preferred are alkyl esters having 2 to 8 carbon atoms, as for example 3-[[bis(1-methylethoxy)phosphinothioyl]thio]propionic acid ethyl ester.

A third class of ashless dithiophosphates for use with the present invention includes:

(i) those of the formula

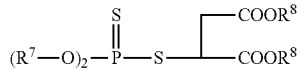

wherein $R^7$ and $R^8$ are independently selected from alkyl groups having 3 to 8 carbon atoms (commercially available as VANLUBE 7611M, from R. T. Vanderbilt Co., Inc.);

(ii) dithiophosphoric acid esters of carboxylic acid such as those commercially available as IRGALUBE® 63 from BASF Corp.;

(iii) triphenylphosphorothionates such as those commercially available as IRGALUBE® TPPT from BASF.; and Zinc salts are preferably added to lubricating compositions in amounts of 0.1-5 triphenylphosphorothionates wherein the phenyl group may be substituted by up to two alkyl groups. An example of this group, among others, is triphenyl-phosphorothionate available commercially as IRGALUBE® TPPT (manufactured by BASF Corp.).

A preferred group of phosphorus compounds are dialkyphosphoric acid mono alkyl primary amine salts, such as those described in U.S. Pat. No. 5,354,484, which is herein incorporated by reference. Eighty-five percent phosphoric acid is the preferred compound for addition to the fully formulated ATF package and is preferably included at a level of about 0.01-0.3 weight percent based on the weight of the ATF.

The amine salts of alkyl phosphates are prepared by known methods, e.g., a method disclosed in U.S. Pat. No. 4,130,494, incorporated herein by reference. A suitable mono- or diester of phosphoric acid or their mixtures is neutralized with an amine. When monoester is used, two moles of the amine will be required, while the diester will require one mole of the amine. In any case, the amount of amine required can be controlled by monitoring the neutral point of the reaction where the total acid number is essentially equal to the total base number. Alternately, a neutralizing agent such as ammonia or ethylenediamine can be added to the reaction.

The preferred phosphate esters are aliphatic esters, among others, 2-ethylhexyl, n-octyl, and hexyl mono- or diesters. The amines can be selected from primary or secondary amines. Particularly preferred are tert-alkyl amines having 10 to 24 carbon atoms. These amines are commercially available as, for example, Primene® 81R manufactured by Rohm and Haas Co. The sulfonic acid salts are well known in the art and are available commercially. Representative of the aromatic sulfonic acids that can be used in preparing the synergists of the invention are alkylated benzenesulfonic acids and alkylated naphthalenesulfonic acids having 1 to 4 alkyl groups of 8 to 20 carbons each. Particularly preferred are naphthalenesulfonates substituted by alkyl groups having 9 to 18 carbons each, as for example dinonylnaphthalenesulfonate.

10. Antifoamants

Antifoaming agents are well known in the art as silicone or fluorosilicone compositions. Such antifoam agents are available from Dow Corning Chemical Corporation and Union Carbide Corporation. A preferred fluorosilicone antifoam product is Dow FS-1265. Preferred silicone antifoam products are Dow Corning DC-200 and Union Carbide UC-L45. Other antifoam agents which may be included in the composition either alone or in admixture is a polyacrylate antifoamer available from Monsanto Polymer Products Co. of Nitro, W. Va. known as PC-1244. Also, a siloxane polyether copolymer antifoamer available from OSI Specialties, Inc. of Farmington Hills, Mich. may also be included. One such material is sold as SILWET-L-7220. The antifoam products are preferably included in the compositions of this invention at a level of 5 to 80 parts per million with the active ingredient being on an oil-free basis.

11. Rust Inhibitors

Embodiments of rust inhibitors include metal salts of alkylnapthalenesulfonic acids.

12. Copper Corrosion Inhibitors

Embodiments of copper corrosion inhibitors that may optionally be added include thiazoles, triazoles and thiadiazoles. Example embodiments of such compounds include benzotriazole, tolyltriazole, octyltriazole, decyltriazole, dodecyltriazole, 2-mercapto-benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles.

The following examples are given for the purpose of further illustrating the invention. All percentages and parts are based on weight unless otherwise indicated.

EXAMPLES

Test Method Used for Observation of Crystallization

Direct observation in 8 oz. glass jars. The glass jars were filled approximately half way. The jars were stored at room temperature and observed over time. Typically the crystallization was first observed at the bottom of the glass jars.

Examples 1-4

Preparation of 1-[Di(4-octylphenyl)aminomethyl]tolutriazole, 50% in Process Oil Containing Polyacrylate Polymer Into a 500 mL round-bottomed flask were added 89.10 g of process oil, 8.61 g of water, 66.25 g of VANLUBE® 81 (benzenamine, N-phenyl-, reaction products with 2,4,4-trimethylpentene), 22.41 g of tolutriazole (also known as tolyltriazole), and 6.09 g of paraformaldehyde are added. This mixture is stirred and heated to 98° C. for 1 hour, 120° C. for 1 hour, then vacuum stripped at 120° C. for 1 hour. The reaction is cooled to 80° to 100° C. and the polyacrylate polymer (Viscoplex®) in mineral oil is added to give 0.5 to 1.0% by weight of polyacrylate polymer in mineral oil to the product. The reaction was stirred at 80° C. or 100° C. for an additional 10 to 60 minutes. Observations for crystallization were carried out weekly. An alternative formation method for the inventive composition would entail starting with the formed tolutriazole, then heating to 80° to 100° C., and proceeding as above.

Examples 5-9

Top Treat of 1-[Di(4-octylphenyl)aminomethyl]tolutriazole, 50% in Process Oil

The sample was prepared as above except that the polyacrylate polymer in mineral oil was not added during the reaction. The polyacrylate polymer in mineral oil was added to various samples at room temperature and stirred for approximately 30 minutes. Some of the sample was left without the addition of polyacrylate polymer, and used as a control. The observations for crystallization were started at 45 days, then weekly thereafter.

TABLE 1

Polyacrylate Polymer Added During Reaction

| Example | Polyacrylate polymer in Mineral Oil | % Polyacrylate polymer in Mineral Oil | Days to Crystals in Glass |
|---|---|---|---|
| 1 | Sample A Viscoplex® 9-144 | 0.5 | None (at least 120 days) |
| 2 | Sample A Viscoplex® 9-144 | 1.0 | None (at least 120 days) |
| 3 | Sample B Viscoplex® 9-213 | 0.5 | 87 |
| 4 | Sample B Viscoplex® 9-213 | 1.0 | 75 |

TABLE 2

Polyacrylate Polymer Top-Treat

| Example | Polyacrylate polymer in Mineral Oil | % Polyacrylate polymer in Mineral Oil | Days to Crystals inGlass |
|---|---|---|---|
| 5 | Control | 0 | 45 |
| 6 | Sample A Viscoplex® 9-144 | 0.5 | 45 |
| 7 | Sample A Viscoplex® 9-144 | 1 | 45 |
| 8 | Sample B Viscoplex® 9-213 | 0.5 | 45 |
| 9 | Sample B Viscoplex® 9-213 | 1 | 45 |

The samples where the polyacrylate polymer in mineral oil was added during the formation reaction for the tolutriazole have shown surprising resistance to crystallization. It is also clear that merely top-treating with polyacrylate polymer, rather than adding during the formation reaction, has no discernable effect.

We claim:

1. A method for reducing crystallization of 1-[Di(4-octylphenyl)aminomethyl]tolutriazole, comprising the steps of:

bringing a first component consisting of 1-[Di(4-octylphenyl)aminomethyl]tolutriazole in process oil to a processing temperature between about 80-100° C., adding to the first component a second component consisting of polyacrylate polymer in mineral oil to give about 0.1 to about 5.0 wt. % polyacrylate polymer as part of a total composition of the first component and second component, stirring the total composition for at least 10 minutes while maintaining the processing temperature, and storing the total composition at room temperature.

2. The method of claim 1, wherein the polyacrylate polymer in mineral oil is added to give about 0.5-1.0 wt. %.

3. The method of claim 1, wherein the 1-[Di(4-octylphenyl)aminomethyl]tolutriazole is diluted at between 40-60% by weight in the process oil.

4. The method of claim 3, wherein the dilution is about 50% by weight.

5. The method of claim 1, further comprising, after the final step, adding the composition to a lubricating composition at about 0.1-3 wt % as part of the lubricating composition.

6. A tolutriazole blend formed by bringing a first component consisting of 1-[Di(4-octylphenyl)aminomethyl]tolutriazole in process oil to a processing temperature between about 80-100° C., adding to the first component a second component consisting of polyacrylate polymer in mineral oil to give about 0.1 to 5.0 wt. % polyacrylate polymer as part of a total composition of the first and second components, and stirring the total composition for at least 10 minutes while maintaining the processing temperature.

7. The method of claim 5, wherein the polyacrylate polymer in mineral oil is added to give about 0.5-1.0 wt. %.

8. The method of claim 5, wherein the 1-[Di(4-octylphenyl)aminomethyl]tolutriazole is diluted at between 40-60% by weight in the process oil.

9. The method of claim 8, wherein the dilution is about 50% by weight.

* * * * *